United States Patent [19]

Georgelin

[11] 4,240,226

[45] Dec. 23, 1980

[54] GUIDING AND ACTUATING DEVICE FOR A SLIDING DOOR

[75] Inventor: Alexandre Georgelin, Bois Colombes, France

[73] Assignee: Faiveley S.A., Saint Ouen, France

[21] Appl. No.: 956,269

[22] Filed: Oct. 31, 1978

[30] Foreign Application Priority Data

Nov. 8, 1977 [FR] France ..... 77 33585

[51] Int. Cl.[2] ..... E05D 15/10

[52] U.S. Cl. ..... 49/223; 49/224; 49/225

[58] Field of Search ..... 49/209–235

[56] References Cited

U.S. PATENT DOCUMENTS 3,906,668 9/1975 Simmons ..... 49/223 X

FOREIGN PATENT DOCUMENTS 2053689 11/1970 Fed. Rep. of Germany ..... 49/223

*Primary Examiner*—Kenneth Downey

*Attorney, Agent, or Firm*—Young & Thompson

[57] ABSTRACT

The device for guiding and actuating a vertical air-tight sliding door is suspended from two carriages each provided with a right-angled support bracket which is capable of horizontal displacement in a slideway. A bent plate which carries the door is rotatably mounted on an elbowed shaft fixed on each carriage. The bent plate carries a roller controlled by a fork and plate assembly which is pivotally mounted on the shaft and actuated by a jack. As the roller reaches the end of the track, the fork and plate assembly is permitted to rotate, with the result that the door carries out a compound movement of downward displacement and application against the wall.

7 Claims, 7 Drawing Figures

FIG. 6
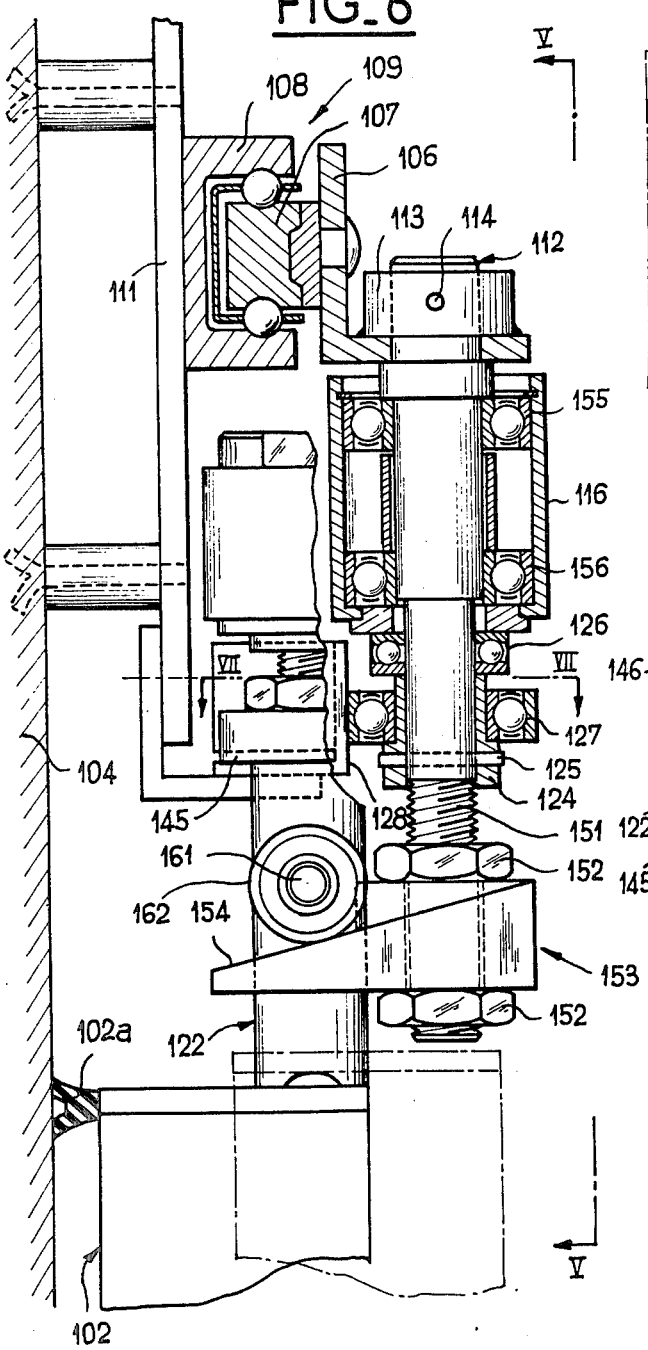
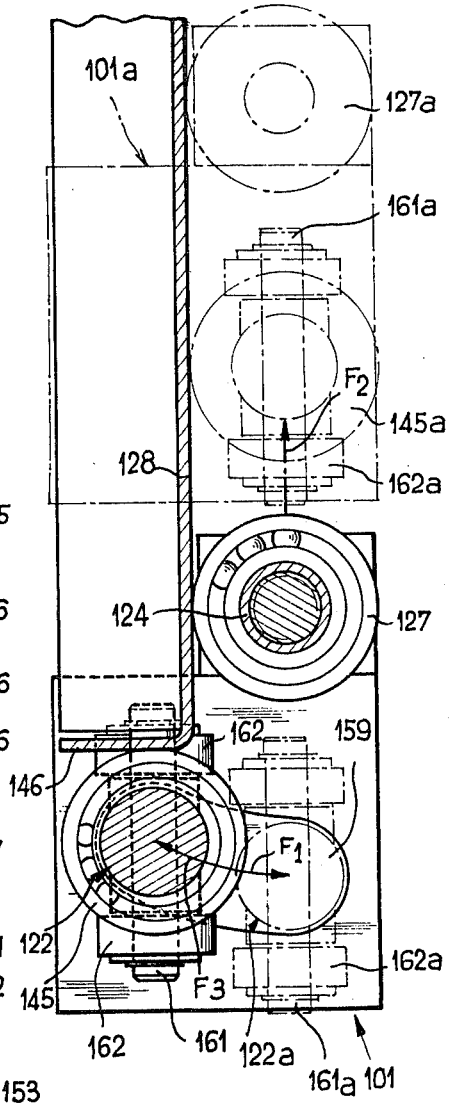
FIG. 7

GUIDING AND ACTUATING DEVICE FOR A SLIDING DOOR

This invention relates to a guiding and actuating device for a vertical air-tight sliding door.

Doors of this type are employed especially for providing access to cold storage rooms or operating theaters. They can also be used as intercommunication doors in high-speed railroad cars in order to contribute to sound insulation and air conditioning as well as to form fire barriers. Doors of this type usually have large dimensions. In order to avoid prohibitive overall size and bulk, it is therefore necessary to provide a door which operates on the sliding principle.

Furthermore, the types of utilization mentioned above entail the need for doors which are fully air-tight. In other words, air-tightness is distributed along that side of the door which is nearest the floor as well as on the three other sides constituted by the frame of the opening to be closed-off.

A known method of providing an air-tight closure of this type consists in subjecting the door, at the end of the closing movement, to a combined movement of downward displacement for compressing a seal in order to form an air-tight joint beneath the door, and of application against the wall in order to compress a seal on said wall along the other three sides of the door.

A movement of this type can be produced in known manner by suspending the door from rollers located in perpendicular planes at 45° to the horizontal and applied against suitably arranged roller tracks constituted, for example, by flat bars or angle-iron flanges. A local depression formed in one of the flat bar-iron members produces the combined movement referred-to above.

A device of this type, however, is subject to a number of drawbacks.

In the first place, all the elements which are mechanically connected to the door carry out the complex movement mentioned above, thus making it difficult to make provision for a power drive system. As a general rule, it is considered sufficient to give an impulse to the door in order to initiate a rectilinear displacement, whereupon the door is allowed to complete the closing movement under its own momentum. This type of operation, however, is liable to give rise to shocks or, on the contrary, to premature stoppages.

In the second place, opening of the door makes it necessary to withdraw the roller from the depression in which it is engaged, preferably by means of a simple mechanical device located outside the room or premises closed by the door. It is in fact necessary to exert an effort on the door in a precise direction which is oblique with respect to the floor and with respect to the wall. Should it be desired to open the door from the inside (this is not only convenient in practice but also constitutes a safety condition), an operating handle must in that case be fitted on the inside of the door in order to transmit a mechanical displacement to the exterior. This forms a premanent metallic thermal bridge which results in a harmful heat loss.

The aim of the present invention is to provide a guiding and actuating device which makes it possible to control the movement by means of an actuating element over the entire range of travel of the door and makes it possible to open this latter from the inside without any auxiliary mechanism.

In accordance with the invention, the guiding and actuating device for a vertical air-tight sliding door for closing an opening formed in a wall and terminating at the level of a horizontal plane which can be the floor comprises suspension means for guiding the door in a direction parallel to the wall and means for applying said door simultaneously against the wall and against the horizontal plane when it is located opposite to the opening aforesaid. The suspension means comprise at least two carriages constrained by guiding means to move horizontally along the wall, each carriage being provided with a first shaft coupled by articulation means to a second shaft which is fixed to the door. Means are provided for locking the articulation means in order to prevent the movement of the second shaft when the door is not located opposite to the opening. The device is distinguished by the fact that both shafts have vertical axes and that the articulation means are so arranged that the second shaft is permitted at the time of release of the locking means to carry out a movement having a component parallel to the direction of the common axis of both shafts.

The two carriages follow a rectilinear path which can be controlled from one end to the other in a simple manner by rectilinear-action driving means. The complex motion of the door is performed at the level of the articulation means independently of the carriages.

In accordance with an advantageous embodiment of the invention, the locking means aforesaid comprise a roller having a vertical axis mounted on a component of the articulation means and applied against a rectilinear roller track which is rigidly fixed to the wall in order to prevent said component from undergoing a rotational displacement accompanied by the second shaft, a gap being formed in the roller track in order to permit release of the roller and unlocking of the device.

It is only necessary to form a gap in the roller track opposite to each carriage when the door comes into position oppsosite to the opening in order to initiate a releasing action which permits rotational displacement of the articulation means and closure of the door.

According to a first embodiment of the invention, the first shaft is elbowed and rotatably mounted on a bent plate which is pivotally coupled to the second shaft by means of a ball-joint assembly, the closing movement of the door being carried out by rotation of the bent plate.

The articulation means accordingly comprise a horizontal driving plate which carries the roller, said driving plate being rotatably mounted on the first shaft and adapted to carry means for providing a mechanical coupling with the bent plate in order to drive said bent plate in rotation.

The means for providing a mechanical coupling between the driving plate and the bent plate comprise a fork mounted on one of the plates and adapted to cooperate with a roller which is mounted on the other plate.

The path of travel of the bent plate is fairly complex and can be considered in a first approximation as enveloping a cone whereas the driving plate undergoes a rotational displacement in a horizontal plane. The fork and roller device gives the necessary degree of freedom to ensure compatibility of these paths of travel.

In order to actuate the device, the driving plate of each carriage is adapted to carry an actuating arm connected by means of a coupling bar to the actuating arm of the other carriage and the complete assembly is controlled by a rectilinear-motion actuating element.

According to a second embodiment of the invention, the second shaft carries an auxiliary carriage adapted to rest on an inclined plane which is rigidly fixed to the first shaft, said inclined plane being so arranged as to apply the roller against the roller track. In this case also, the door suspension carriages are coupled to a rectilinear-motion actuating element.

Further distinctive features of the invention will become apparent from the following detailed description, reference being made to the accompanying drawings which are given by way of example without any limitation being implied, and in which:

FIG. 6 is a transverse sectional view taken along line VI—VI of FIG. 5;

FIG. 7 is a sectional plan view taken along line VII—VII of FIG. 6 with an additional indication of the open position of the door.

Figure 1:
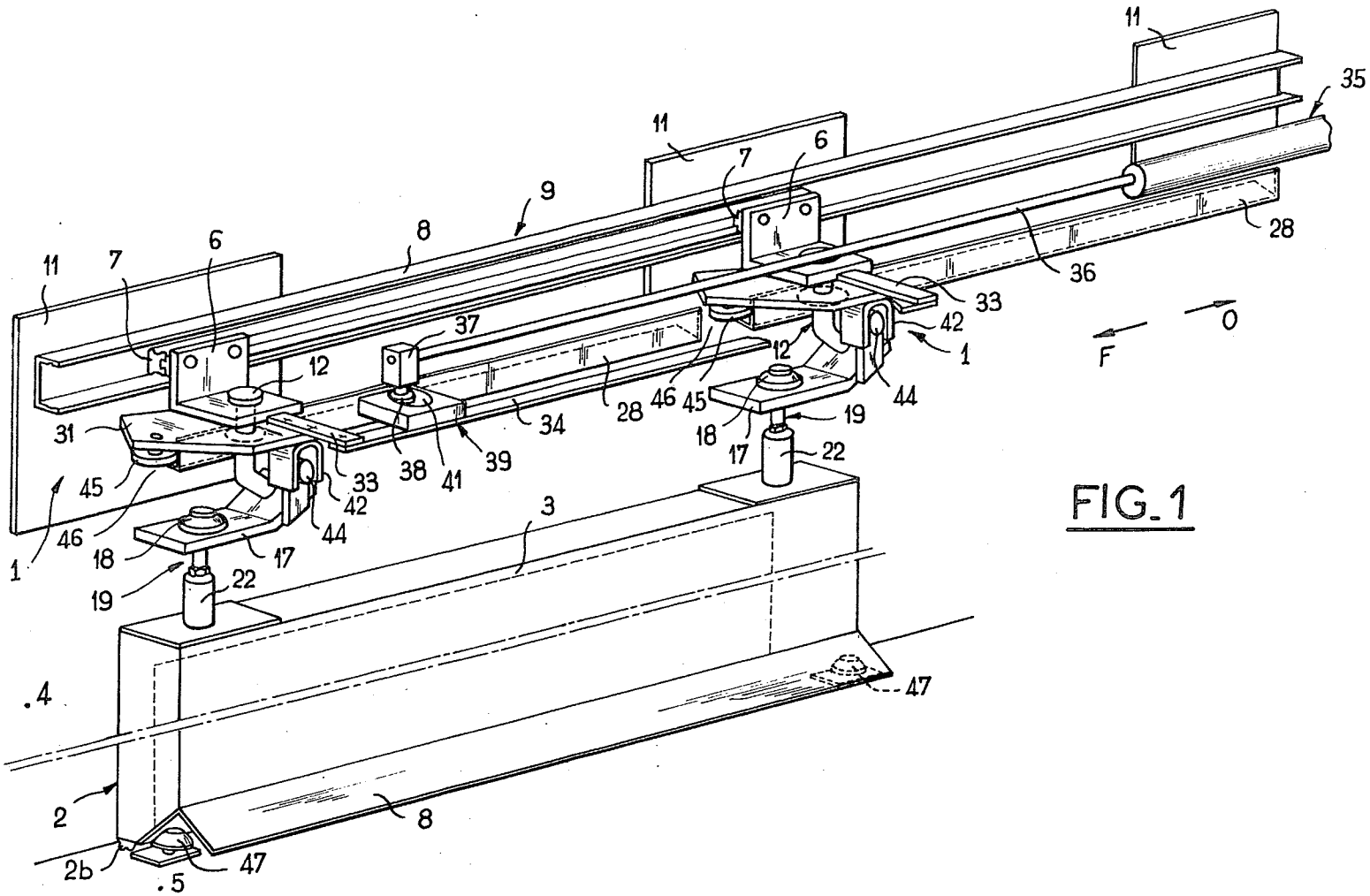
FIG. 1 is a general view in perspective showing a first embodiment of the invention in the closed position of the door.

Referring first to FIGS. 1 to 4, the device in accordance with the invention comprises two carriages 1 from which is suspended a door 2 for closing-off an opening 3 in a wall 4, this opening being such as to extend to the level of the floor 5.

The carriages 1 are each provided with a right-angled support bracket 6 fixed to a ball-bearing cage 7 which is adapted to run within a roller track 8 constituting a slideway 9 which is secured to the wall 4 by means of mounting plates 11, with the result that the carriages 1 are capable of displacement in rectilinear motion parallel to the wall 4.

In more exact terms, the slideway 9 is fixed within a recess of the wall 4, the depth a of said recess (shown in FIG. 3) being determined as a function of the dimensions of the carriages in such a manner as to ensure that the door 2 can be applied against the wall 4 and compress a plastic seal 2*a* which is placed along its periphery.

A first vertical shaft 12 is rigidly fixed to the right-angled support bracket 6 by means of a ring 13 which is welded to the support bracket and by means of a dowel-pin 14. The lower portion 15 of the shaft 12 is elbowed and adapted to carry a bent plate 17 by means of a plain bearing 16. A second vertical shaft 19 from which the door 2 is suspended is pivotally coupled to said bent plate by means of a ball-joint assembly 18. In order to adjust the height of the door 2 with respect to the floor, the shaft 19 is provided with a screw-thread 21 in cooperating relation with an internally-threaded sleeve 22 which is welded to the door, said vertical shaft being locked in position by means of a counter-nut 23.

The plain bearing 16 is keyed axially by means of a ring 24 through which is passed a locking-pin 25 and by means of a ball-thrust bearing 26.

Since the slideway 9 is not located in the vertical plane of the door 2, the shaft 12 carries a ball-bearing roller 27 which cooperates with a roller track 28 disposed in parallel relation to the slideway 9 and which is retained axially by means of an annular shoulder 29. In consequence, the roller 27 which is applied against the track 28 absorbs the moment of rotation applied to the carriage 1 by the door 2.

A horizontal driving plate 31 is rotatably mounted on each of the two shafts 12 in the vertical portion thereof by means of a plain bearing 32. There is fixed on said plate an actuating arm 33 which is pivotally coupled to a coupling bar 34.

Figure 3:
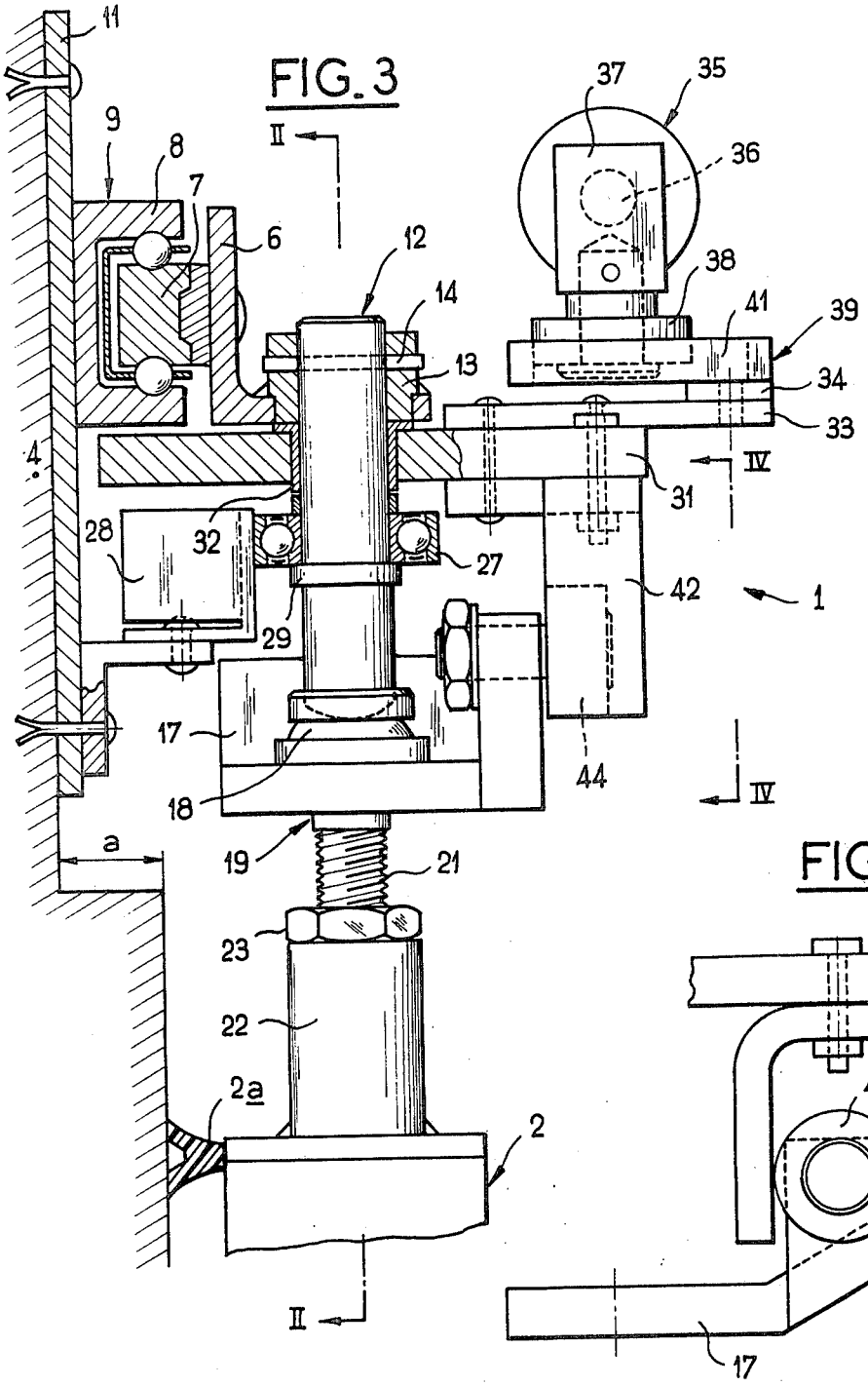
FIG. 3 is a sectional view taken along line III—III of FIG. 2.
Figure 4:
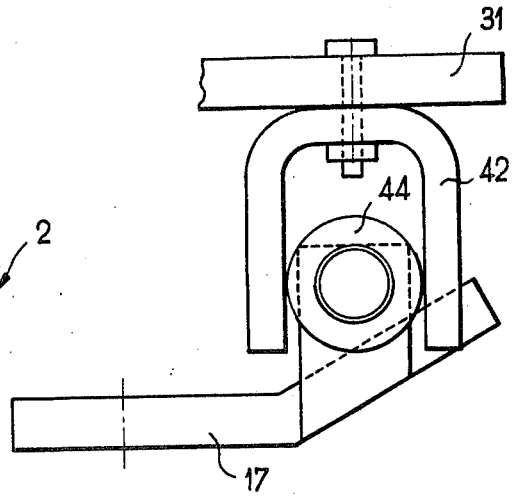
FIG. 4 is a view taken along line IV—IV of FIG. 3.

A jack 35 has a movable operating rod 36, the head 37 of which cooperates by means of a roller 38 with an articulation member 39 which is fixed on the coupling bar 34 and provided with an oblong hole 41 (as shown in FIGS. 1 and 3).

The driving plate 31 carries a fork 42 constituted by a U-shaped sheet metal plate, the base of which is rotatably mounted on a pin 43. Said fork cooperates with a roller 44 carried by the bent plate 17 in such a manner as to ensure that the bent plate 17 and the driving plate 31 constitute an articulation assembly for transmitting the movements of the jack 35 to the door 2. The fork 42 is intended to be of slightly greater width than the roller 44 (FIG. 3) in order to permit a certain relative displacement.

Figure 2:
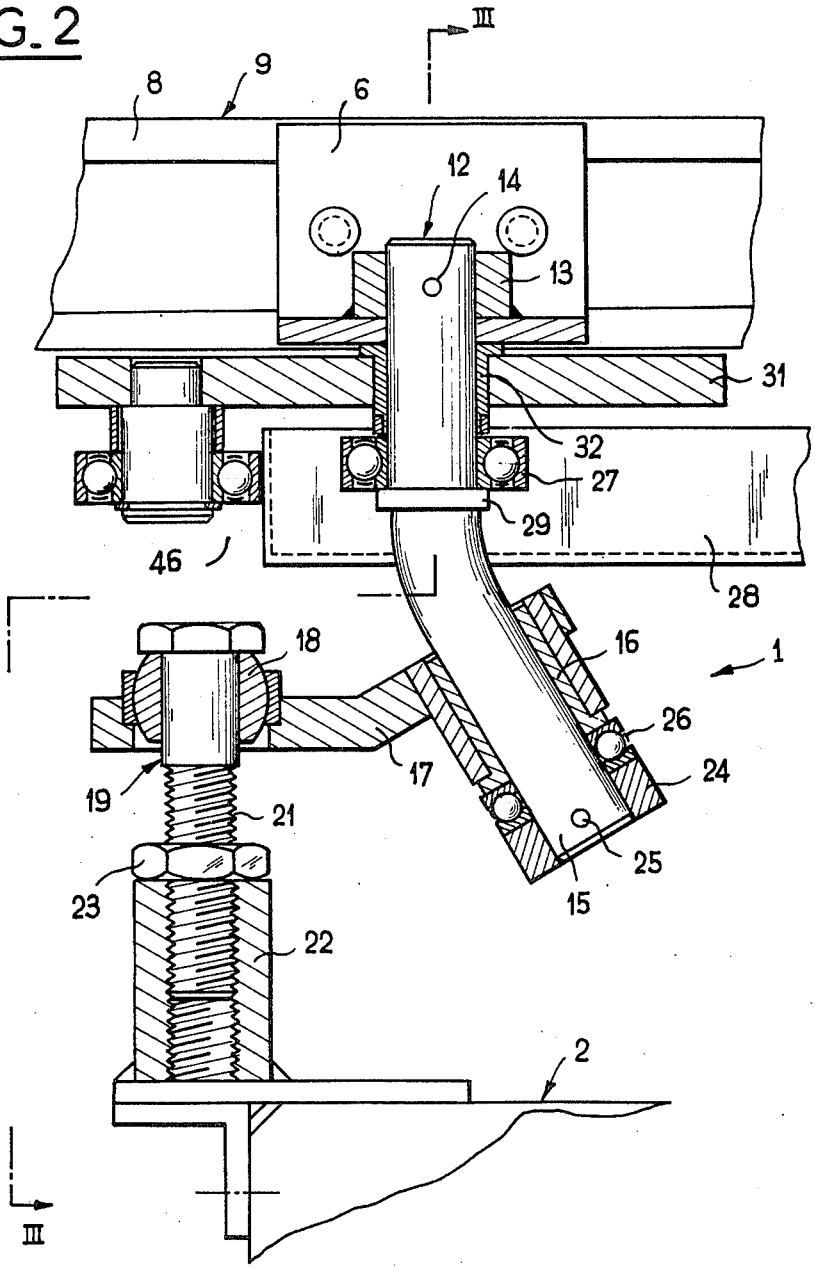
FIG. 2 is a sectional view taken along line II—II of FIG. 3 and showing one of the carriages of FIG. 1.

Finally, the driving plate 31 carries a roller 45 having a vertical axis. Depending on the position of the carriages 1 on the slideway 9 and on the angular position of the plate 31, said roller 45 is capable of running along the roller track 28 or (as shown in FIGS. 1 and 2) of engaging in a gap 46 of said roller track.

The operation of the device hereinabove described is as follows.

Starting from the closed-door position shown in the figures, the jack 35 is actuated so as to cause displacement of its operating rod 36 towards the right in the direction of the arrow O (FIG. 1). The force transmitted by the coupling bar 34 to the actuating arms 33 causes the driving plates 31 to rotate in the anticlockwise direction (looking from above). The bent plates 17 are thus driven in rotation around the oblique lower portions 15 of the shafts 12 by means of the forks 42 and the rollers 45.

The movement of the bent plates 17 is imparted to the shafts 19 by means of the ball-joint assemblies 18 and subject the door to a compound movement having the effect on the one hand of moving the door away from the wall 4 and on the other hand of lifting the door which is thus no longer in contact with the floor.

At the same time, the rotation of the plates 31 has the effect of withdrawing the rollers 45 from the gaps 46 of the roller track 28 in which they had been engaged. They can then roll along said track, thus displacing the carriages 1 and the door 2 towards the right in a direction parallel to the wall 4.

When the opening 3 is completely freed, conventional end-of-travel devices stop the motion of the jack 35.

From this open position, the reverse operation of the jack 35 in the direction of the arrow F first initiates a translational displacement of the door 2 in a direction parallel to the wall 4 so that each carriage 1 runs in the slideway 9 by means of its roller 27 and 45 whilst the plates 31 are urged to rotate, any movement of rotation being prevented, however, by the rollers 45 which are applied against the track 28.

When the rollers arrive in front of the gaps 46 of the track 28, this tendency to rotate causes them to engage in the gaps, thus giving rise to rotational displacement of the plates 31 and of the articulation means, the door 2 being thus permitted to move downwards and towards the wall 4. During this movement, the door 2 compresses the seal 2*b* against the floor whilst the seal 2*a* which is fitted on the other three sides of the door is compressed against the wall. The bottom portion of the door is then guided by conical guides 47 in cooperating relation with an angle-iron member 48 which is fixed on the door.

During the displacements mentioned above, the motion of the operating rod of the jack is strictly rectilinear and capable of following the displacement of the carriages 1 by means of the hole 41 which is slightly oblong in order to take into account the movement of the coupling bar 34. The movement of the door can therefore be carried out and controlled from one end to the other since the jack does not directly actuate the door but only by means of the device in accordance with the invention which ensures conversion of the movement. Smooth control of this movement can therefore be ensured from one end of travel to the other.

Furthermore, the articulation means are wholly reversible. Thus in the event of failure, any person who may be trapped on the other side of the door can readily initiate opening of the door, first by exerting a thrust which moves it away from the wall and lifts it. Once the rollers 45 have thus been disengaged, the door can then be displaced laterally in sliding motion and simply as a result of adhesion of the operator's hands, the only forces to be overcome being rolling resistance forces of negligible value. There is therefore no need whatsoever to provide any mechanism for transmitting an operation from one side of the door to the other. Should it prove necessary to do so in the case of very heavy doors, a mechanism of this type can be constituted by an entirely external element which has the effect of multiplying the effort exerted by the operator.

A second embodiment of the invention will now be described with reference to FIGS. 5 to 7 which show only the details of a carriage since it will be understood that the general arrangements can be found in the complete illustration of the device which is given in FIG. 1. In this further description, elements which are similar to those described in te previous embodiment will be designated by the same reference numeral increased by 100.

In this embodiment, at least two carriages such as the carriage 101 support a door 102, said door being intended to close-off an opening (not shown) which terminates on a horizontal plane such as the floor and which is formed in a wall 104. Each carriage 101 comprises a right-angled support bracket 106 suspended from a ball-bearing cage 107 which is mounted in a roller track 108 so as to form a slideway 109 which is fixed on a mounting plate 111, said plate being in turn anchored in the wall 104.

The carriage 101 further comprises a first shaft 112 which is secured to the support bracket 106 by means of a ring 113 and a dowel-pin 114, said ring being welded to said support bracket. Said shaft is provided at the lower end with a threaded portion 151 on which are engaged two nuts 152 for fixing a member 153 on said threaded portion. Said member has an inclined plane 154, the slope of which is directed towards the wall 104.

The shaft 112 carries a roller 127 which is adapted to roll on a track 128 for absorbing the couple resulting from vertical forces applied along the axis of said shaft.

By means of two ball-bearings 155, 156, the shaft 112 aforesaid is further adapted to carry a rotatable housing 116 supported by means of a ball-thrust bearing 126 on a ring which is keyed by means of a dowel-pin 125.

A second shaft 119 (shown in FIG. 5) has a threaded portion 121 which is screwed into a sleeve 122 which is in turn fixed to the door 102 by any suitable means such as an intermediate plate 157. A counter-nut 123 serves to lock the shaft 119 in position within the sleeve 122.

At the upper end, the shaft 119 is carried by a plain bearing 118 incorporated in a housing 158 which is rigidly fixed to the housing 116 by means of a web 117, said housing 116 being capable of rotating about the shaft 112. In consequence, the shaft 119 is capable of turning around the shaft 112; the sleeve 122 traverses the member 153 freely through an elongated opening 159 having the desired configuration.

A spindle 161 traverses the sleeve 122 and both ends of said spindle carry rollers 162 which rest on the inclined plane 154, with the result that the aforesaid movements of rotation of the shaft 119 are accompanied by a movement of axial translation of said shaft which results in sliding motion within the plain bearing 118.

Finally, the sleeve 122 carries a roller 142 which is capable of running along the track 128 and subsequently escaping from said track when it passes beyond the extremity 146 of this latter.

The operation of the device is carried out by means of a rectilinear-motion driving element which has not been illustrated for the sake of enhanced clarity but can be a jack of the type described in relation to the previous embodiment. Said element directly actuates the right-angled support brackets 106 which can be coupled together by means of a special bar or simply by the door 102.

Figure 5:
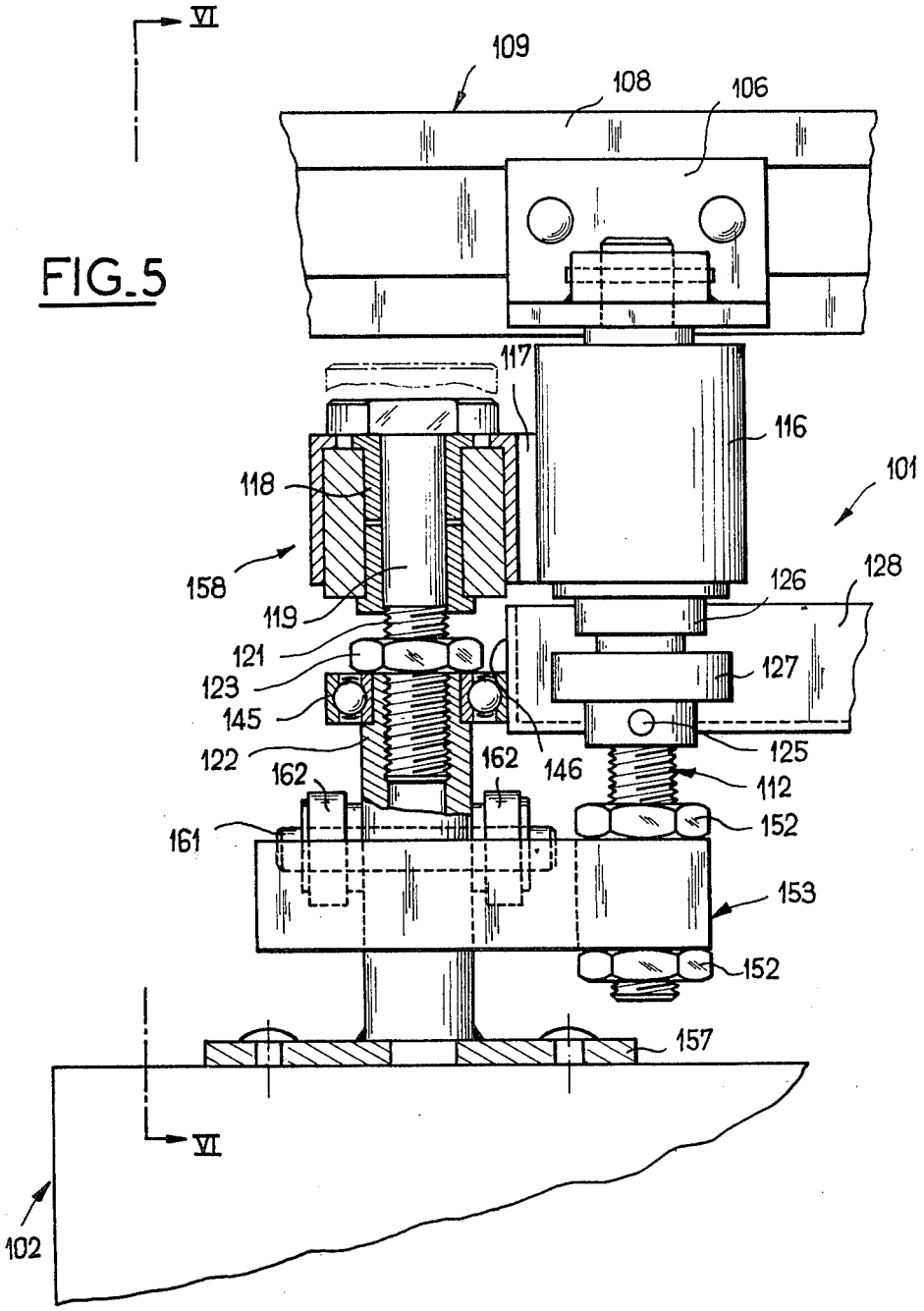
FIG. 5 is a part-sectional view in elevation showing one of the carriages in a second embodiment of the invention and in the closed position of the door.

The operation of the device which has thus been described is as follows:

Assuming that the door 102 is in the closed position shown in FIGS. 5 to 7, the driving element is caused to apply a force which is parallel to the slideway 109. This force produces a reaction of the extremity 146 of the track 128 on the roller 145. The rollers 162 are thus caused to move upwards along the inclined plane 154 and are accompanied by the sleeve 122 which undergoes a displacement within the elongated opening 159 in the direction of the arrow F1, thus moving the door 102 away from the wall 104.

The movement continues until the roller 145 has escaped from the extremity 146 and the sleeve 122 has moved to position 122*a* (as shown in FIG. 7). The complete carriage can then move in the direction of the arrow F2 whilst the rollers 127 and 145 run along the track 128. The carriage 101 then comes into a position such as 101*a* shown in chain-dotted lines in FIG. 7, whereupon the door 102 moves in a direction parallel to the wall 104. Stopping of this movement is effected by means of end-of- travel stops of known type when opening previously closed-off by the door is completely uncovered.

The closing operation is preformed in the opposite direction and begins with a displacement of the carriages 101 in a direction parallel to the slideway 109 whilst the rollers 127 and 145 run along the track 128. When the roller 145 reaches the end of the track, it escapes and allows the rollers 162 to run down the inclined plane 154 while displacing the sleeve 122 from position 122*a* to position 122 in the direction of the arrow F3 (as shown in FIG. 7). As a result of this movement, the door is applied against the wall with compression of the seal 102*a* while at the same time moving downwards and compressing the seal 102*b* (not shown) on the floor.

Once the door has been closed, it is always possible to re-open it by hand from the interior in the event of failure of the actuating motor. It is only necessary to push the door outwards in order to move it away from the wall, whereupon the rollers 162 move upwards along the inclined plane 154. At this point, since the seals 102*a* and 102*b* are no longer engaged and the roller 145 has moved away from the extremity 146, it is only necessary to apply a very light lateral thrust simply as a result of adhesion of the hands, for example, in order to initiate a lateral displacement of the door.

The embodiment just described makes it possible to obtain substantially the same advantages of air-tightness and continuity of control as in the previous embodiment, the differences being of a purely technological order and the choice between them being dependent only on the conditions of manufacture.

It is also possible to contemplate many other embodiments which constitute only alternative forms within the same general purview of the invention. For example, on the basis of the first embodiment described in the foregoing, the first shaft could be straight instead of elbowed, in which case it would be rotatably mounted in an inclined position. The "bent plate" could in that case be flat and welded to the shaft in an approximately horizontal position and not perpendicular to said shaft. It is apparent that the means thus employed are equivalent to those described earlier.

Similarly, the rectilinear-motion actuating element can be of any suitable type such as hydraulic or pneumatic jack or an electric motor provided with an endless screw.

We claim:

1. A guiding and actuating device for a vertical air-tight sliding door for closing an opening formed in a wall and terminating at the level of a horizontal plane which can be the floor, comprising suspension means for guiding the door in a direction parallel to the wall and means for applying said door simultaneously against said wall and against said horizontal plane when it is located opposite to the opening aforementioned, the suspension means being constituted by at least two carriages constrained by guiding means to move horizontally along the wall, each carriage being provided with a first shaft coupled by articulation means to a second shaft fixed to the door, and means for locking the articulation means being provided in order to prevent the movement of the second shaft when the door is not located opposite to the opening, wherein both shafts have vertical axes and wherein the articulation means are so arranged that the second shaft is permitted at the time of release of the locking means to carry out a movement having a component parallel to the direction of the common axis of both shafts, the locking means comprising a roller having a vertical axis mounted on a component of the articulation means and applied against a rectilinear roller track which is rigidly fixed to the wall in order to prevent said component from undergoing a rotational displacement accompanied by the second shaft, a gap being formed in the roller track in order to permit release of the roller and unlocking of the device, the first shaft being elbowed and rotatably mounted on a bent plate which is pivotally coupled to the second shaft by means of a ball-joint assembly, the closing movement of the door being carried out by rotation of said bent plate.

2. A device according to claim 1, wherein the articulation means comprise a horizontal driving plate which carries the roller, said driving plate being rotatably mounted on the first shaft and adapted to carry means for providing a mechanical coupling with the bent plate in order to drive said bent plate in rotation.

3. A device according to claim 2, wherein the means for providing a mechanical coupling between the driving plate and the bent plate comprise a fork mounted on one of the plates and adapted to cooperate with a roller which is mounted on the other plate.

4. A device according to claim 3, wherein the plate for driving each carriage is adapted to carry an actuating arm connected by means of a coupling bar to the actuating arm of the other carriage.

5. A device according to claim 4, wherein the system formed by the driving plates and the coupling bar is connected to a rectilinear-motion actuating element.

6. A guiding and actuating device for a vertical air-tight sliding door for closing an opening formed in a wall and terminating at the level of a horizontal plane which can be the floor, comprising suspension means for guiding the door in a direction parallel to the wall and means for applying said door simultaneously against said wall and against said horizontal plane when it is located opposite to the opening aforementioned, the suspension means being constituted by at least two carriages constrained by guiding means to move horizontally along the wall, each carriage being provided with a first shaft coupled by articulation means to a second shaft fixed to the door, and means for locking the articulation means being provided in order to prevent the movement of the second shaft when the door is not located opposite to the opening, wherein both shafts have vertical axes and wherein the articulation means are so arranged that the second shaft is permitted at the time of release of the locking means to carry out a movement having a component parallel to the direction of the common axis of both shafts, the locking means comprising a roller having a vertical axis mounted on a component of the articulation means and applied against a rectilinear roller track which is rigidly fixed to the wall in order to prevent said component from undergoing a rotational displacement accompanied by the second shaft, a gap being formed in the roller track in order to permit release of the roller and unlocking of the device, the second shaft carrying an auxiliary carriage adapted to rest on an inclined plane which is rigidly fixed to the first shaft, said inclined plane being so arranged as to apply the roller against the roller track.

7. A device according to claim 6, wherein the door suspension carriages are coupled to a rectilinear-motion actuating element.

* * * * *